United States Patent [19]

Wilbur

[11] 3,958,746

[45] May 25, 1976

[54] SPECIAL SHIPPING CASE FOR ELIMINATION OF CUT CONTAINER CONTENTS

[75] Inventor: Charles J. Wilbur, Barrington, Ill.

[73] Assignee: The Quaker Oats Company, Chicago, Ill.

[22] Filed: Feb. 27, 1975

[21] Appl. No.: 553,564

[52] U.S. Cl. ..... 229/38; 229/44 R; 229/51 CE

[51] Int. Cl.[2] ..... B65D 5/08

[58] Field of Search ..... 229/37 R, 38, 39 R, 229/33, 51 R, 51 CE, 36, 44 R

[56] References Cited

UNITED STATES PATENTS

| | | | |
|---|---|---|---|
| 1,211,857 | 1/1917 | Johnson | 229/37 R X |
| 1,223,232 | 4/1917 | Ash | 229/37 R |
| 3,007,376 | 11/1961 | Hickin et al. | 229/37 R X |
| 3,516,593 | 6/1970 | Larsen | 229/33 |
| 3,519,194 | 7/1970 | Kohlhaas et al. | 229/37 R X |
| 3,743,167 | 7/1973 | Russell | 229/33 X |

*Primary Examiner*—William Price
*Assistant Examiner*—Stephen P. Garbe

[57] ABSTRACT

Tops of shipping cases are routinely severed for price marking of package contents, and this process incurs substantial cutting of contents, e.g. cereal packages and the like. A shipping case is disclosed which substantially eliminates this kind of damage to the contents. In accordance with the present invention the shipping case includes a top panel positioned adjacent the tops of the package contents, which top panel includes dependent flaps extending downwardly along at least three sides of the package, the dependent flaps being free of any connection to the body along the entire edge adjacent the top panel, and being attached to the body of the case beyond this cutting zone.

3 Claims, 12 Drawing Figures

FIG. 1
PRIOR ART
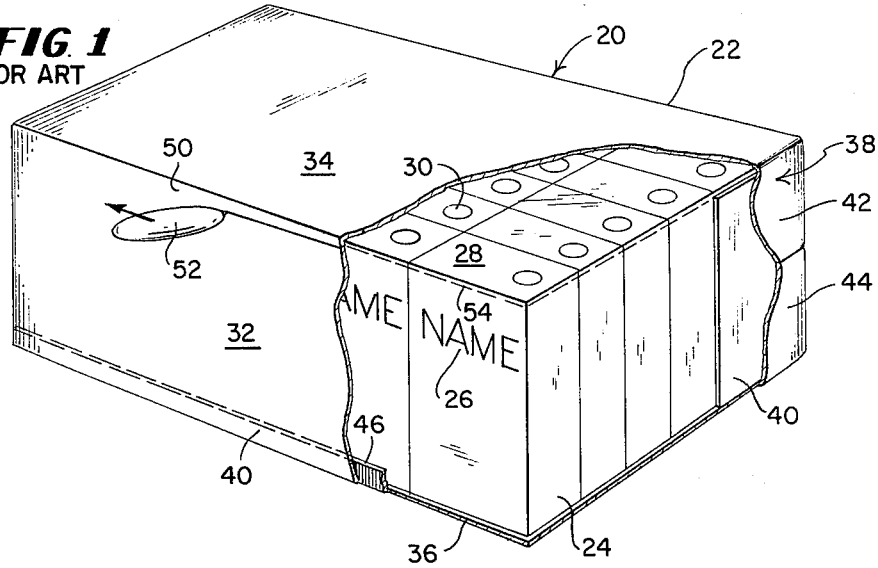
FIG. 2
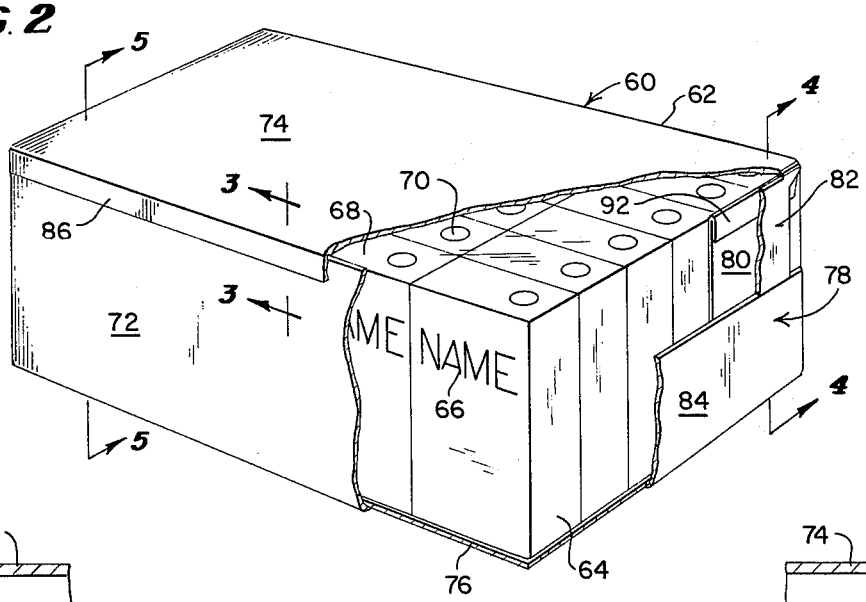
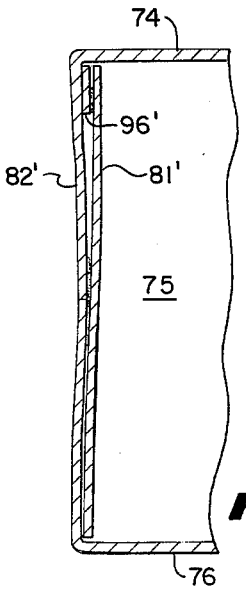
FIG. 5
FIG. 3
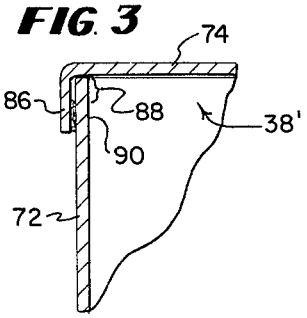
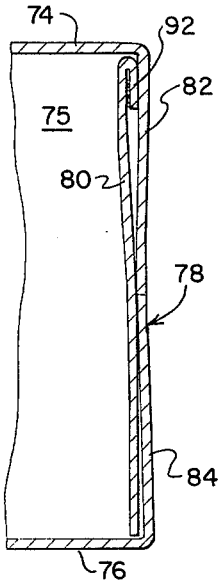
FIG. 4

| | | | |
|---|---|---|---|
| 1 (1) | 2 (2) | 2 (3) | 1 (4) |
| 0 (5) | | | 0 (6) |
| 1 (7) | | | 2 (8) |
| 2 (9) | | | 0 (10) |
| 0 (11) | | | 0 (12) |
| 5 (13) | 5 (14) | 4 (15) | 3 (16) |

| | | | |
|---|---|---|---|
| 0 (1) | 0 (2) | 0 (3) | 0 (4) |
| 0 (5) | | | 0 (6) |
| 0 (7) | | | 0 (8) |
| 0 (9) | | | 0 (10) |
| 0 (11) | | | 0 (12) |
| 0 (13) | 0 (14) | 0 (15) | 0 (16) |

SPECIAL SHIPPING CASE FOR ELIMINATION OF CUT CONTAINER CONTENTS

BACKGROUND OF THE INVENTION

This invention relates to a special shipping case for elimination of cut carton contents upon opening the case for price marking and stacking of the cartons on a store shelf, for example.

Considerable problems have been encountered in connection with inadvertent cutting of ready-to-eat cereal cartons, and the like, by store clerks when shipping cases are opened for price marking of the contents. Typically the clerk will run the knife blade along two ends and a side of a case immediately below the top of the case in order to pivot the top open, and in some instances, the top of the case is removed entirely. Knives having a short blade of pre-set length are customarily used for this. A long standing problem has been the fact that cartons adjacent an outer wall of the case are likely to be cut. In recent investigation of this problem, it has been observed in laboratory tests that from 15 to 40 percent of the vulnerable cartons, that is, cartons immediately adjacent the outside of the shipping case, were cut or damaged by the store clerk's knife during removal of the shipping case top in the preparation for price marking of the contents.

This problem has been found to have become particularly aggravated during the present trend towards higher density cereal products. While I do not intend to be bound by any theories of operation in connection with this invention, it is my belief based on repeated observation that in many instances a small gap is provided by the manufacturer between the top of a shipping case and the top of the content cartons. If the store clerk were to draw the opening knife along the outside of the shipping case in that top portion thereof which corresponds to the small gap between the top of the contents and the top of the shipping case, it is apparent that no substantial damage would occur to the contents of the case. However, it has been learned that upon stacking of cases on pallets, and upon stacking of loaded pallets on top of one another for storage, the weight forces involved generally result in the collapse of the small gap between the top of the content cartons and the top of the shipping case. This is particularly exaggerated in those instances involving a relatively high density product such as, for example, a high density natural ready-to-eat cereal as distiguished from a low density puffed ready-to-eat cereal. When the clerk draws the knife along the outside of the shipping case, regardless of how close to the top of the case the blade stays, the knife will probably, and in fact does damage a large percentage of the contents, using heretofore available shipping cases.

SUMMARY OF THE INVENTION

The store cut damage to shipping case carton contents is substantially eliminated by providing a corrugated board shipping case assembly in accordance with the present invention.

In accordance with the present invention the tops of the shipping case contents are arranged within a shipping case to be adjacent a top panel of the case, the top panel of the case having flaps dependent along at least three edges thereof. These flaps, in accordance with the present invention, depend from the top panel over the outside of the body of the case, and are free from attachment to the underlaying body of the shipping case along an elongated zone adjacent the edge of the top panel. The dependent flaps are secured, for example, by glueing, to the body of the case beyond the attachment-free zone. Upon opening the case in accordance with the present invention, the drawing of the knife through the flaps in the attachment-free zone along three edges of the top panel severs the top panel from the remaining portions of the dependent flaps which secure the top panel in its shipping configuration, permitting the top panel to be hinged upwardly for price marking of the cartons inside. If desired, the top panel can be totally severed by cutting through the top panel along the hinged edge from the inside face of the top panel with no risk whatsoever to the contents.

In accordance with a preferred embodiment of the present invention, the improved shipping case is made from a single blank, requires no additional currugated board, results in no waste of corrugated board, involves no additional assembly steps, and is assembled and filled and closed using unmodified conventional equipment.

The invention will be described in general and with the aid of particularly preferred embodiments by means of the following description and drawings in which:

FIG. 1 is a perspective cut-away view of a shipping assembly in accordance with the PRIOR ART.

FIG. 2 is a perspective cut-away view of a shipping assembly in accordance with the present invention.

FIG. 3 is a fragmentary cross-sectional elevational view taken approximately along the line 3—3 of FIG. 2.

FIG. 4 is a fragmentary elevational cross-sectional view taken approximately along the line 4—4 of FIG. 2.

FIG. 5 is a fragmentary cross-sectional elevational view taken approximately along the line 5—5 of FIG. 2.

Figure 6:
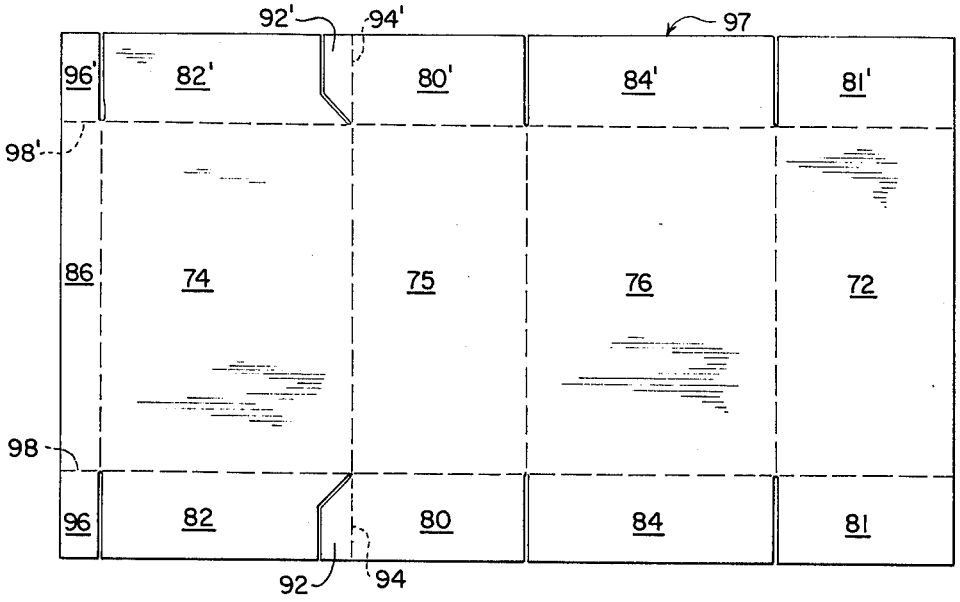
FIG. 6 is a plan view of a blank of a case in accordance with the present invention.

FIG. 1 is intended to illustrate the typical and very widely used structure in accordance with the prior art. A shipping assembly is generally indicted by the numeral 20 and includes a shipping case 22 having a plurality of packages 24 packed therein. It is noted that the packages 24 normally have indicia 26 imprinted thereon and that indicia 26 determines that one end 28 of package 24 is designated as the "top" of package 24. Typically indicia 30 is also provided at the top end 28 to facilitate price marking and price checking of the merchandise namely packages 24.

The shipping case 22 is typically manufactured from corrugated paperboard and includes a front panel 32, top panel 34, a rear panel (not shown), and a bottom panel 36. Each end wall generally indicated by the numeral 38 is made up of a pair of minor end flaps 40 folded and integrally hinged from the front panel 32 and the rear panel (not shown), and a pair of major end flaps 42, 44. A glue lap flap 46 is integral with and hinged to bottom panel 36 and is glued along glue lap 48 to the "bottom" of front panel 32. Thus, in accordance with the prior art, glue lap 46 is situated along the bottom of packages 24 and on the inside of front panel 32. A single layer of corrugated paperboard covers packages 24 at the top thereof at the top portion of panel 32 which is normally cut by the clerk's knife 52, for example. Upon opening of the case 22 with a knife 52 as indicated in FIG. 1 it has been discovered that the packages 24 which are adjacent the front panel 32 and rear panel 34 are virtually certain to be damaged by the clerk's knife 52. This damage typically results in a slash 54 in the face of one or more of the packages 24.

Typically the store clerks will place damaged packages 24 on the store shelves, and in many instances the damaged cartons are purchased, reluctantly, by the consumer. In an increasing number of instances, however, the consumer refuses to purchase store-cut packages and, in the absence of any good shipping assembly which eliminates the likelihood of store-cut cartons, reputable manufacturers, being sympathetic with the difficult position in which the store is placed, have policies in favor of buying back damaged merchandise from the store. This is a waste of resources of time, effort and material and constitutes an undesirable hidden cost borne ultimately by the consumer.

In the following description of the shipping assembly in accordance with the present invention, and from the comparison of actual test data reported in FIGS. 11 and 12 it will be appreciated that the shipping assembly in accordance with the present invention substantially eliminates the store-cut package problem.

FIGS. 2–10 illustrate a structure in accordance with the present invention.

In FIG. 2 a shipping assembly in accordance with the present invention is generally indicated by the numeral 60. Assembly 60 comprises shipping case 62 and a plurality of packages 64 contained therein. Packages 64 have indicia 66 imprinted thereon which results in one end 68 of package 64 being regarded as the "top." Additional indicia 70 on top end 68 is typically provided for price marking.

Case 62 comprises a front panel 72, top panel 74, rear panel 75 and bottom panel 76.

The end walls of case 62 are generally indicated by the numeral 78, 78'. End walls 78, 78', respectively, each comprise a pair of minor end flaps 80, 80', 81, 81', top major end flaps 82, 82' and bottom major end flaps 84, 84'. In addition a glue lap flap 86 is integral with and hinged to top panel 74 and, in the assembled carton, overlaps the top edge of front panel 72 and is secured thereto. (See FIG. 3). However, in accordance with the present invention, the glue lap flap 86 is not secured to front panel 72 along the top marginal zone 88 and is secured by glue, for example, along zone 90 which is parallel to and below or beyond zone 88. Zone 88 is positioned between glue zone 90 and the top panel 74. The width of zone 88 is not critical, but it is preferred that it extend at least ¼ inch and preferably ½ to ⅝ inch from the bottom of top panel 74.

In accordance with the preferred embodiment illustrated in FIGS. 2–10 respective hinged flaps 92, 92' are provided. Hinged flaps 92, 92' are integral with and hinged to rear minor end flaps 80, 80' along respective score lines 94, 94' but, as will be appreciated from a consideration of FIG. 5, the material from which hinged flaps 92, 92' are made is taken from what typically would have been the material of major end flaps 82, 82'. FIGS. 2 and 4 shows hinged end flaps 92 folded down between minor end flap 80 and major end flap 82. The other hinged flap 92' is similarly positioned between minor end flap 80' and major end flap 92'.

Figure 7:
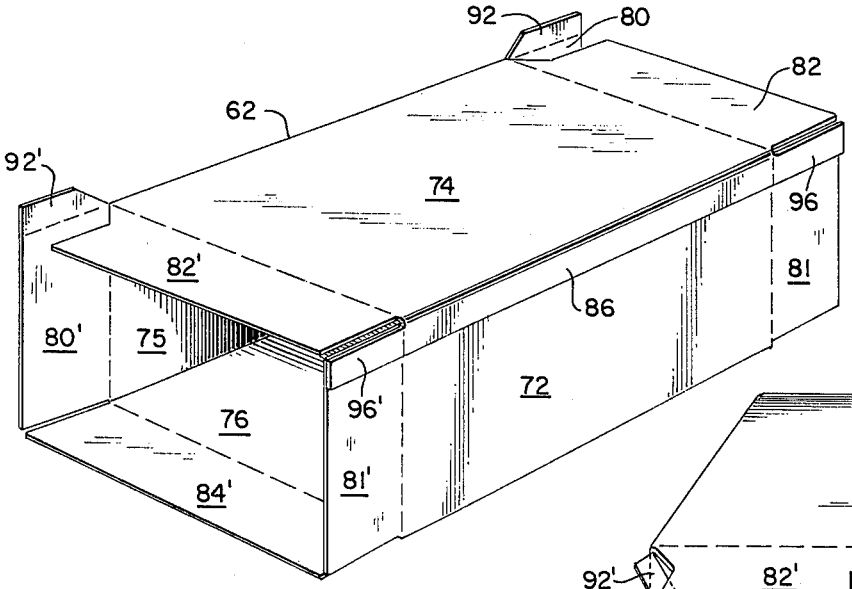
FIG. 7 is a perspective view of a partially assembled case in accordance with the present invention.

Also, in accordance with the preferred embodiment of this invention, glue lap flap 86 has laterally extending wings 96, 96' respectively extending from either end thereof and being hinged thereto along respective score lines 98, 98'. Lap wings 96, 96' are glued, respectively, to minor end flaps 81, 81' as viewed in FIG. 7 so that, as shown in FIG. 5, the glue lap wings 96, 96' are positioned between minor end flaps 81, 81' and major end flaps 82, 82' respectively. Referring now to FIG. 7, in which a partially assembled case 62 is shown, it will be appreciated glue lap wings 96, 96' are secured to the faces of minor end flaps 81, 81' respectively and glue lap flap 86 is secured, as illustrated in FIG. 3 to the outside of front panel 72.

Figure 8:
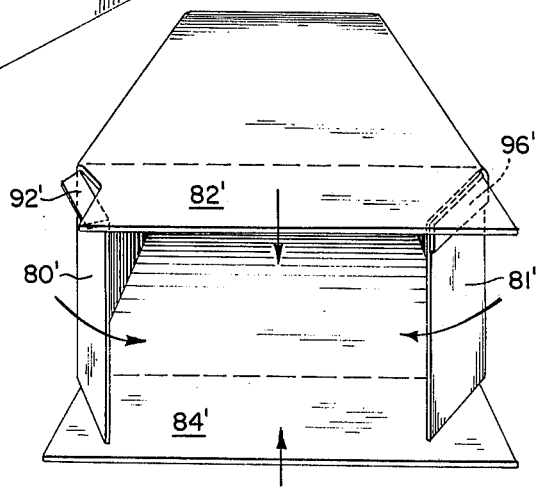
FIG. 8 is a perspective view of a partially assembled case in accordance with the present invention being closed to provide an improved assembly in accordance with the present invention.

Due to the inherent stiffness and resiliency of the corrugated paperboard material, hinged flaps 92, 92' project upwardly from rear minor end flaps 80, 80' when the case 62 is in the partially assembled tubular condition shown in FIG. 7. Thus, as illustrated in FIG. 8, when minor end flap 80 is folded frontwardly into alignment with front minor end flap 81 the hinged flap 92 is automatically tucked under major end flap 82' and the wing 96' is automatically pivoted under major end flap 82' as well. The same thing happens under the closing of the other end wall 78.

From a consideration of FIG. 6 it is apparent that the preferred shipping case of this invention can be made from a single blank.

It will be appreciated by those skilled in the art that the third layers of material provided by hinged flap 92, 92' and wings 96, 96' are incorporated into the preferred shipping assembly of the present invention without the consumption of any additional corrugated board, and it will also be appreciated that the assembly process in which the third, that is the middle layers of material provided by hinged flaps 92, 92' and wings 96, 96' is achieved automatically without the need for provision of additional equipment.

When a knife 52 is drawn through glue lap flap 86 with its blade passing through flap 86 in the unattached zone 88 the top panel 74 is severed from front panel 72, as indicated in FIG. 2 without damage to cartons 64 contained therein. Also, as shown in FIG. 9, I have discovered that such placement of a third layer of corrugated material provided by hinged flaps 92, 92' and attached wings 96, 96' increases the extent of separation between major end flap 82 and contents 64 in that end flap gap 101 between front and rear minor end flaps 80, 81 and 80', 81' respectively.

Figure 9:
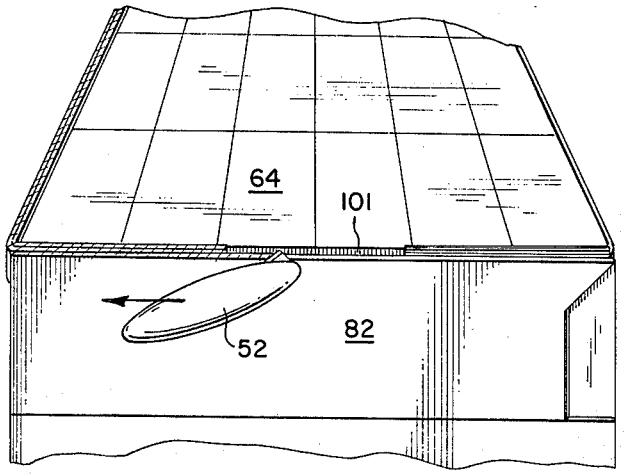
FIG. 9 is a perspective end view illustrating a case in accordance with the present invention being opened.

This is illustrated in FIG. 9 which shows the top panel 74 completely separated from the remaining portion of the assembly and in which shows the knife 52 positioned against major end flap 82. FIG. 10 illustrates the final separation of the top panel, if such should be desired, by drawing the knife 52 along that portion of panel 74 which is adjacent the remaining portion of the assembly 60.

Figures 10, 11, 12:
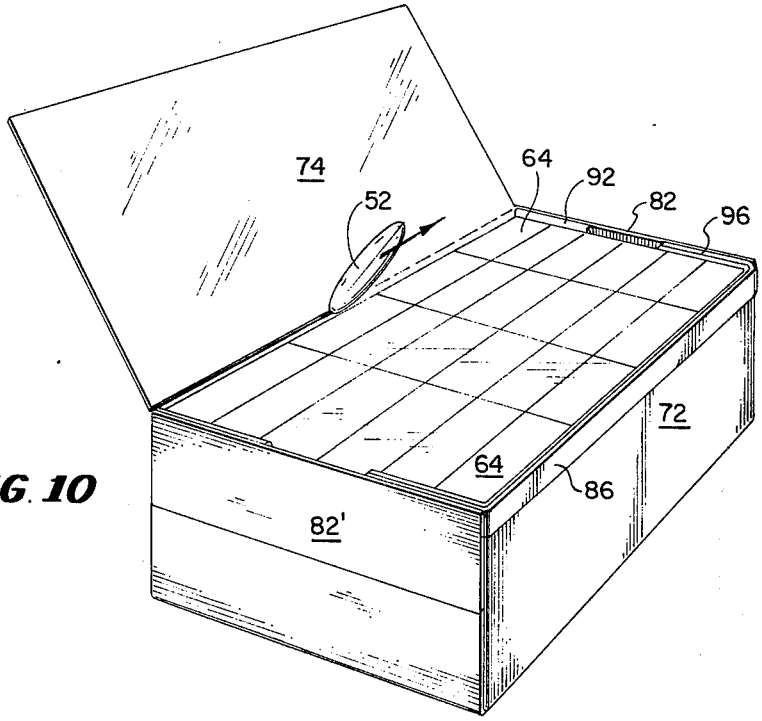
FIG. 10 is a perspective view of a case in accordance with the present invention which has been opened, illustrating the position of the knife during complete severing of the top panel.
FIG. 11 is a diagram corresponding to a top plan view of a loaded case in accordance with the prior art illustrating the extent of damaged cartons contained therein upon being opened by cutting of the shipping case.
FIG. 12 is a diagram corresponding to the diagram of FIG. 11 except that the data of FIG. 12 illustrates that none of the cartons in the test were damaged when the shipping case in accordance with the embodiment shown in FIG. 2 was used.

FIGS. 11 and 12 illustrate the profound difference with respect to the substantial elimination of store-cut damage when using the shipping assembly in accordance with the present invention.

In a carefully observed test 12 shipping assemblies 20 and 12 shipping assemblies 60 in accordance with the present invention were opened by individuals who either were or have worked as stock clerks in stores. These persons were not briefed as to the purpose of the test, and were instructed to cut along dotted lines imprinted along the top edge of major end flaps 38, 38' and glue lap 86. In this test each person opened one prior art assembly 20 and one assembly in accordance with the present invention 60. The packages 24 and 64 were then examined carefully and the position of those packages which were cut was noted and the results were tabulated. Specifically, the number of cut packages at each position were summarized. The results of the tests are summarized in FIGS. 11 and 12. FIG. 11 corresponds to a diagrammatic top plan view of assembly 20 but showing only the positions of the individual packages 24, which positions are numbered 1 through 16, respectively. It is noted that only the exterior package positions are so numbered, inasmuch as these are the only package positions vulnerable to store-cut damage of the type to which the invention is directed. The degree of shading, and the large arabic numbers represent the degree of damage which was observed in the 12 packages in each respective position in the 12 tests. Thus, in the 12 tests packages 24 at positions 1, 4 and 7 were cut only one time. Two packages in positions 2, 3, 8 and 9 were cut, three packages in positions 16, four packages in position 15 and five packages in positions 13 and 14 were cut. Thus a total of 28 packages were damaged in the "control" test using a typical prior art shipping assembly 20. In the 12 tests, therefore, 192 packages were "vulnerable" and 14.5 percent were "store-cut."

In the 12 tests using assemblies 60 in accordance with the present invention in which the "clerk" opened the shipping assembly 60 by cutting along the 3 sides comprising ends 82, 82' and the front glue lap flap 86, and then severing the top panel 74 as indicated in FIG. 10 by drawing knife 52 along that portion of panel 74 which is closest to the remaining part of the assembly. In the latter instance, when case in accordance with the present invention was used, and in which the procedure outlined immediately above was followed, not one single carbon 64 suffered store-cut type damage.

I claim:

1. A shipping assembly comprising a corrugated paperboard shipping case having a plurality of containers packed therein; said containers having indicia imprinted thereon whereby one face of the respective containers is characterized as a respective top thereof; said containers being positioned within said case so that the respective tops of the containers underlay the top panel of the case; said case having ends thereof comprising a pair of minor end flaps hinged along edges of the body of the case which are substantially perpendicular with respect to said top panel; said minor end flaps having relatively narrow separator strips secured thereto, extending along the top edge of said minor end flaps; said top panel of said shipping case having flaps dependent from along at least three edges thereof; said flaps being unattached to the body of the case in a cutting zone along the entirety of said edges of said top panel, said flaps being secured to the body of the case below said zone.

2. The assembly of claim 1 in which at least two of said dependent flaps are first respective major end flaps which abut second respective opposing major end flaps extending upwardly from the bottom of said case.

3. A corrugated shipping case comprising a top panel, back panel, bottom panel and front panel, each of said panels being delineated by respective score lines; said top panel being secured to said front panel by means of a glue lap flap integral with said top panel and delineated by a score line between said glue lap flap and said top panel, said glue lap flap overlaying a portion of said front panel, said glue lap flap being unattached to said front panel along a zone adjacent said glue lap flap score line and secured to said front panel beyond said zone; respective minor end panels extending from both ends of said front and rear panels and delineated therefrom by score lines therebetween, major end flaps extending from both ends of said top and bottom panels and being delineated therefrom by respective score lines; said major end flaps being free of attachment to said minor end flaps along a top cutting zone, and being attached to said minor end flaps below said cutting zone; wherein the minor end flaps extending from the front panel have extensions of said glue lap secured thereto on the edge of said minor end flaps destined to be adjacent said top panel upon complete assembly of the container; the respective minor end flaps extending from ends of the back panel having integral tabs extending upwardly beyond the score line extension of the score line delineating the top and rear panels, said score line extension extending along that edge of said rear minor end flap destined to be adjacent the top panel upon complete assembly of said container.

* * * * *